United States Patent [19]

Ishii

[11] 4,323,239

[45] Apr. 6, 1982

[54] BASEBALL BAT

[76] Inventor: Junichi Ishii, 3073, Kamihongo, Matsudo City, Japan

[21] Appl. No.: 138,042

[22] Filed: Apr. 8, 1980

[30] Foreign Application Priority Data

Apr. 17, 1979 [JP] Japan ..... 54-46981

[51] Int. Cl.[3] ..... A63B 59/06

[52] U.S. Cl. ..... 273/72 A

[58] Field of Search ..... 273/67 R, 67 D, 67 DA, 273/72 R, 72 A, 80 R, 80 B, 81 R, 73 R, 73 C, 73 F, 73 G, 73 H, 73 J, 80.2, 80.4, 80.8; 124/23 R; 43/18 R; 343/900

[56] References Cited

U.S. PATENT DOCUMENTS

| | | | |
|---|---|---|---|
| 1,680,447 | 8/1928 | Bryant | 273/80.8 X |
| 1,792,034 | 2/1931 | Reach | 273/80.4 |
| 2,017,303 | 10/1935 | Bear | 43/18 R |
| 2,967,710 | 1/1961 | Carlson | 273/72 R |
| 3,310,903 | 3/1967 | Binvignat | 273/80 B X |
| 3,479,030 | 11/1969 | Merola | 273/72 A |
| 3,801,098 | 4/1974 | Gildemeister | 273/72 A |
| 4,214,395 | 7/1980 | Caldwell | 273/80 B X |

*Primary Examiner*—Richard J. Apley

*Attorney, Agent, or Firm*—Sughrue, Mion, Zinn, Macpeak and Seas

[57] ABSTRACT

A hollow baseball bat made of a rigid material, such as a metal or a plastic and having a double structure comprising a hollow bat body and a reinforcing member disposed in the grip portion and the bending portion positioning the base end side of the bat. The reinforcing member has a trumpet-formed opening and forms a gap gradually increasing toward the opening portion between the inner wall of the bending portion of the bat. The outer circumferential surface of the reinforcing member and functions to reinforce the strength and elastic force of the bat when the bat is bent by impact of pitched ball.

7 Claims, 7 Drawing Figures

FIG. 1
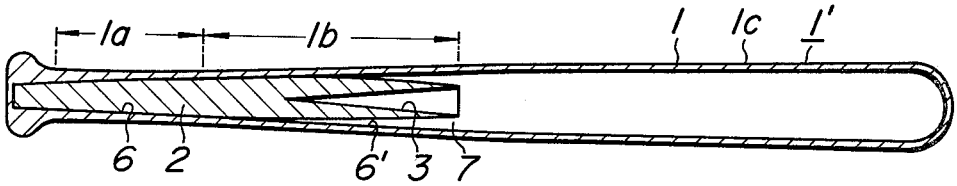
FIG. 2A'
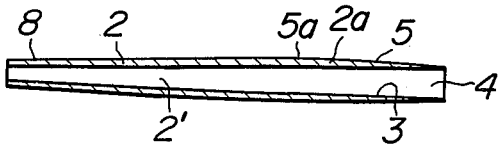
FIG. 2B'
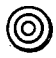
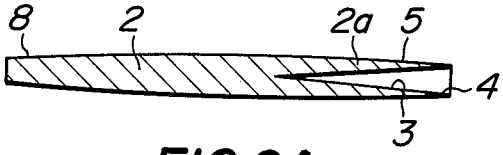
FIG. 2A
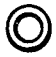
FIG. 2B
FIG. 3
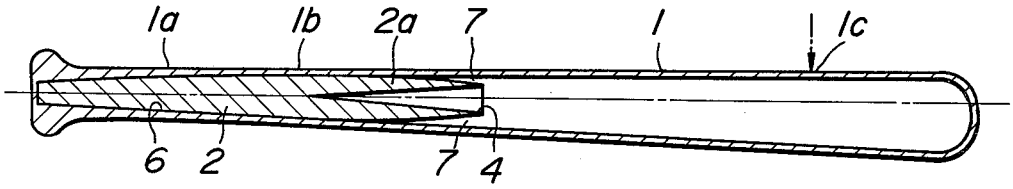
FIG. 4
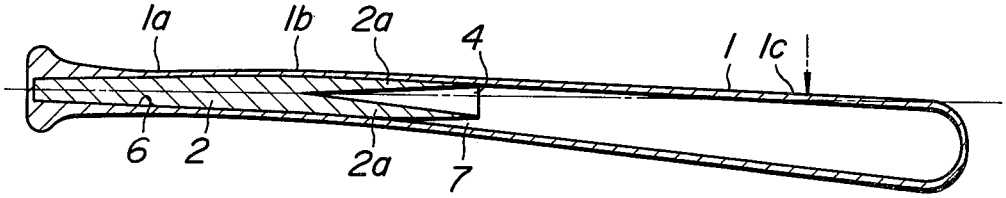

BASEBALL BAT

The present invention relates to a hollow baseball bat formed of a rigid material, such as metal, plastics and the like and more particularly to a baseball bat having a high repelling power wherein a reinforcing member is disposed at a grip portion and a bending portion of the bat.

Recently, metal bats have been developed and used in view of economy because wood baseball bats are readily broken and wood for producing the baseball bat has become scarce. However, a conventional metal bat is a hollow bat formed of a single member per se or a hollow bat packed with foamed urethane and the like for improving the batting sound. Accordingly, these bats having a pipeform as a whole do not exhibit the effective batting ability which utilizes the flexible phenomenon found in wood bats.

The dynamics of the flight of a ball are based on the following theory in the batting of the baseball. When a ball is struck with a bat, the bat is bent at impact moment to a curved form and the ball is deformed to about $\frac{3}{4}$ of the diameter of the ball and advances together with the bat in a state that the ball engages tightly with the sweet spot (impact center) portion of the bat and in this case, the elastic force of the bat reaches the limit and the bending of the bat stops. When the bat reaches the above described state, that is "the state where the bending of the bat stops due to elastic force of the " (referred to as "the bending stopped state due to elastic force" hereinafter), the power of the batter is initially transmitted to the ball. When the batter wants the ball to travel the maximum distance, it is absolutely necessary to apply the power to the ball under such a state of the bat. But, in this case, if the ball considerably misses striking the sweet spot of the bat or the power of the batter is unexpectedly strong, the bat reaches the elastic limit and is broken.

Unless the elastic force of the bat reaches the limit and the bending of the bat stops due to the elastic force, the ball can not effectively fly a far distance. This power applying manner determines the technical ability of the batter and this is the batting technique called "follow-throw". For example, when the elastic force of the bat is strong and too rigid, the pitched ball leaves the bat too rapidly when striking the bat and there is no time to apply power to the bat; conversely when the elastic force of the bat is too soft, the distance where the ball and the bat advance while engaging together, is too long, the power of the batter can not be applied in a concentrated manner (the termination of the bending of the bat can not be attained and a buffering function is generated), so that both cases can not attain the effective batting.

From this point, in conventional metal bats, in order to prevent breakage, the thickness of the bending portion is made excessively large, so that the elastic force which is most important in the bat, is deficient. Therefore "the bending stopped state due to elastic force" comes too rapidly and it is impossible to form the state where the bat is bent owing to the force of the pitched ball and the ball releases from the bat immediately when striking the bat and it is impossible to apply the power of the batter to the bat. That is, the ball flies in proportion to only the power and the batter who lacks power, can not hit the ball technically by the follow-through.

The present invention has been made to solve the above described problem and is bat in which the grip portion and the bending portion are constructed with a double structure, whereby any batter whether having poor power or strong power can attain the follow-through effect.

The present invention comprises a hollow baseball bat made of a rigid material, such as metal or rigid plastic wherein a reinforcing member is disposed in the inner hollow portion at the grip portion and the bending portion in such a relation that the reinforcing member is tightly engaged with the inner wall of the grip portion and forms a gradually increasing gap toward the top end of the reinforcing member between the inner wall of the bending portion of the hollow bat and the outer circumferential surface of the top portion of the reinforcing member.

The present invention will be explained in more detail hereinafter.

For better understanding of the invention, reference is taken to the accompanying drawings, in which:

FIG. 1 is a vertical cross-sectional view of a baseball bat according to the present invention;

FIGS. 2(A) and (B) are a vertical cross-sectional view and a front view of one embodiment of a reinforcing member respectively and FIGS. 2(A') and (B') are a vertical cross-sectional view and a front view of other embodiment of reinforcing member respectively;

FIG. 3 is a vertical cros-sectional view for showing the state when a baseball bat is subjected to a weak impact by a pitched ball; and FIG. 4 is a vertical cross-sectional view for showing the state when a baseball bat is subjected to a strong impact.

Referring to FIG. 1, numeral 1 is a hollow baseball bat body formed of a rigid material, such as a metal (for example aluminum alloy) or a rigid plastic and in a grip portion 1*a* and a tapered bending portion 1*b*, which position at the base end side of the hollow bat, is inserted a reinforcing member 2 as shown in FIG. 2A and formed of the same material as the hollow baseball bat body or a material having a slightly higher toughness than the bat body. The metal bat body is manufactured in a conventional process, for example through a mechanical drawing process wherein a metal tube material having a diameter substantially equal to the largest diameter of a desired ball bat is formed into a bat by gradually reducing the diameter of the tubular material toward the grip portion of the bat. The reinforcing member 2 has the structure as shown in FIG. 2A. The top end portion (hitting side) of the reinforcing member opposing to the bending portion forms a trumpet-shaped opening 4 having a larger diameter and at the inside, a conical cavity 3 in which the wall thickness 2*a* is gradually reduced toward the hitting side, is provided and the outer circumferential surface of the top portion of the reinforcing member curves and forms such an arced surface 5 that when the bending portion of the hollow baseball bat body 1 is bent by the force of the pitched ball, the outer circumferential surface of the reinforcing member fits to the inner wall of the bending portion 1*b* of the bat body. The reinforcing member 2 is firmly inserted in the hollow bat 1 in such a state that the reinforcing member 2 is firmly engaged (6) with the inner wall of the grip portion 1*a* and forms a gradually increasing gap 7 toward the top side between the inner wall 6 at the bending portion 1*b* and the outer circumferential surface of the reinforcing member. Thus, the bat 1' according to the present invention has a double structure at the grip portion 1*a* and the bending portion 1*b*. The tapered portion 8 formed at the base end portion of the reinforcing member 2 acts wedge function to surely fix the reinforcing member in the grip side of the hollow bat body 1. Another embodiment of the reinforcing member 2 according to the present invention is shown in FIG. 2A'.

The reinforcing member 2 is disposed in the bat body 1 in the following manner. For example, the reinforcing member 2 is inserted from an opening (not shown) formed at the top end of the hollow bat body 1 and forced into the grip portion by a convenient pressing means (not shown) so as to reach an innermost recess in the grip portion 1*a* and fixed therein. In this case, if necessary, an adhesive may be applied to the firmly engaging portion 6. Furthermore, a weight member or an impact resisting member (not shown) may be disposed in the contact portion 1*c* of the hollow bat body 1 to adjust the weight and balance of the bat.

An explanation will be made with respect to the functional mechanism of the baseball bat according to the present invention. A batter grasps the grip portion 1*a* in the same manner as in a usual bat and swings the bat.

When a ball (not shown) strikes the contact portion 1*c* of the hollow bat body 1 and this impact is relatively weak, only the hollow bat body 1 comprising the outer periphery curves as shown in FIG. 3. The pitched ball force is resisted by the elastic force of only the bat body and the inner wall of the bending portion 1*b* does not still contact with the core-likely disposed reinforcing member 2 because a gap 7 is previously formed between the inner wall of the hollow bat body and the outer circumferential surface of the reinforcing member 2. The rigidity of the reinforcing member 2 does not act and the first "bending stopped state due to elastic force" is attained only by the elastic force of the hollow bat body 1 per se and the followthrough is feasible.

When the impact of the pitched ball is higher or an unexpected higher force is applied to the bending portion due to hitting of the ball at the position of the contact portion 1*c* far distant from the sweet spot, the force exceeds the elastic force of the hollow bat body 1 per se and the bat is further bent as shown in FIG. 4. If the bending more proceeds, when the reinforcing member according to the present invention is not provided, the bat is broken. However, in the hollow bat according to the present invention, at this stage, the inner wall of the hollow bat 1 contacts with the outer circumferential surface of the reinforcing member 2 and presses the reinforcing member 2, so that the strength and the elastic force of the bat are increased by the reinforcing member to endure the impact force and the second "bending stopped state due to elastic force" is obtained and the breakage of the bat can be prevented and the follow-through is feasible. Since the wall thickness of the top portion 2*a* of the reinforcing member 2 gradually decreases toward the top end, as the bending degree of the hollow bat body 1 becomes larger due to increase of the impact, the influence to the thinner wall portion 2*a* of the reinforcing member 2 gradually extends to the thicker wall side and the substantial "resilience" is always generated. Accordingly, the "bending stopped state due to elastic force" can be attained and the bat is not broken. Furthermore, the trumpet-formed opening portion 4 at the end of the thinner wall portion 2*a* which positions at the hitting side of the reinforcing member 2, is flexible and freely deformable and acts a buffering function which does not apply unnatural drag to the hollow bat body 1. Accordingly, this bat does not cause "numbness" which is a defect of the conventional metal bat and the batter's hands do not become momently senseless.

As mentioned above, in the present invention, the reinforcing member provided with an inwardly tapered cavity at one end directing to the batting portion is disposed in the grip portion and the bending portion of the hollow bat body in such a structure that a gap gradually increasing toward the top end is formed between the inner wall of the bending portion and the outer circumferential surface of the reinforcing member, to form a double structure, whereby the bending of the bat is stepwise. Therefore, when the impact of the pitched ball is weak, said impact is resisted only by the elastic force of the hollow bat body, and when the impact is strong, said impact is resisted by the hollow bat body and the reinforcing member and the bat and the ball advance under the state where the bat and the ball are tightly engaged and during this advance, the batter's force transmits to the ball. That is, the accurate follow-through can be effected and the flying distance of the ball can be increased by the batter's technique. This means that even a batter having a lower arm power can drive the ball a greater distance with the follow-through technique commensurate with a batter having a higher arm power.

When selecting the bat, heretofore a batter having a lower arm power has selected a bat having a relatively lower elastic force and a batter having a higher arm power has selected a bat having a higher elastic force respectively, but in the present invention one bat can be used by both the batters having lower and higher arm powers. Furthermore, since the reinforcing member is used as a core, there is no fear that the bat is broken and there is no danger causing by breakage of the bat. Moreover, the wall thickness of the bat body can be more reduced than that of the conventional metal bat, so that the bat according to the present invention can obtain the same degree of flexibility as in wood bat. In addition, the bat of the present invention breaks far less and one bat is applicable to both batters having the lower arm power and the higher arm power, which has never been attained in the wood bat.

What is claimed is:

1. In a hollow baseball bat made of a rigid material and having an impact portion, a grip portion and a flexible bending portion positioned between said impact and grip portions and joining these two portions, the improvement comprising; a circular sectional reinforcing member having a tapered cavity extending along its longitudinal axis from an end face of said member on a side of said impact portion of said baseball bat toward said grip portion, said reinforcing member having a slightly bulged surface formed at its outer circumference on an end portion on the side of said impact portion, and the wall thickness of an end portion of said reinforcing member formed having said tapered cavity gradually reducing toward said impact portion in conjunction with said tapered cavity, said reinforcing member being disposed in said grip and flexible bending portions such that said reinforcing member is in close contact with at least an inner surface of said grip portion but forms a gap gradually diverging toward said impact portion between at least a part of an inner surface of said bending portion and an outer circumference of the end portion of said reinforcing member.

2. A baseball bat as claimed in claim 1, wherein the reinforcing member is constructed with a solid material at a portion opposing to the grip portion and with an inwardly tapered cavity at the opening side.

3. A baseball bat as claimed in claim 1, wherein the reinforcing member is constructed with a pipe-formed hollow member.

4. A baseball bat of claim 1 wherein said rigid material is metal.

5. A baseball bat of claim 1 wherein said rigid material is plastic.

6. A baseball bat of claims 4 or 5 wherein said reinforcing member is metal.

7. A baseball bat of claims 4 or 5 wherein said reinforcing member is rigid plastic.

* * * * *